US006776081B2

(12) United States Patent
Casinge et al.

(10) Patent No.: US 6,776,081 B2
(45) Date of Patent: Aug. 17, 2004

(54) PNEUMATIC ACTUATOR SYSTEM

(75) Inventors: Tom Allan Casinge, Mullsjö (SE); Stig-Erling Gustavsson, Brämhult (SE)

(73) Assignee: Parker Hannifin AB, Boras (SE)

( * ) Notice: Subject to any disclaimer, the term of this patent is extended or adjusted under 35 U.S.C. 154(b) by 8 days.

(21) Appl. No.: 10/344,337

(22) PCT Filed: Aug. 10, 2001

(86) PCT No.: PCT/SE01/01729

§ 371 (c)(1),
(2), (4) Date: Feb. 11, 2003

(87) PCT Pub. No.: WO02/14698

PCT Pub. Date: Feb. 21, 2002

(65) Prior Publication Data

US 2003/0173210 A1 Sep. 18, 2003

(30) Foreign Application Priority Data

Aug. 15, 2000 (SE) ..... 0002905

(51) Int. Cl.[7] ..... F15B 15/028
(52) U.S. Cl. ..... 91/403; 91/392
(58) Field of Search ..... 91/306, 392, 397, 91/403

(56) References Cited

U.S. PATENT DOCUMENTS 3,400,062 A * 9/1968 Bruno et al. ..... 205/336
3,620,126 A * 11/1971 Fuhrimann ..... 91/306
3,660,256 A * 5/1972 Lippitt et al. ..... 205/336
3,712,857 A * 1/1973 Piller et al. ..... 205/336
4,680,930 A * 7/1987 Dollison ..... 91/306
5,253,575 A * 10/1993 Claar et al. ..... 91/392
5,542,336 A 8/1996 Larkin
5,944,045 A * 8/1999 Allen et al. ..... 91/403

FOREIGN PATENT DOCUMENTS

DE 4 201 464 A1 7/1993
EP 0 552 557 A1 7/1993

* cited by examiner

*Primary Examiner*—Thomas E. Lazo
(74) *Attorney, Agent, or Firm*—Frishauf, Holtz, Goodman & Chick, P.C.

(57) ABSTRACT

A pneumatic actuator system is provided which includes one or more piston-cylinder type actuators (14) intended for crust breaking operations at electrolytic alumina reduction baths. Each actuator (14) includes a working piston (21), and a piston rod (22) carrying a crust breaking working implement (17). A control circuit having a directional valve (24) is arranged to operate the actuator piston (21) in alternative directions. The control circuit includes air feed flow restrictions (26, 27), end position sensors (28, 29) and air feed shut-off valves (30, 31) for minimizing the pressure air volume needed for accomplishing complete working strokes of the actuator piston (21) at varying crust layer thickness.

10 Claims, 4 Drawing Sheets

PNEUMATIC ACTUATOR SYSTEM

This application is a U.S. National Phase Application under 35 USC 371 of International Application PCT/SE01/01729 filed Aug. 10, 2001.

This invention relates to a pneumatic actuator system including one or more piston-cylinder type actuators, each having a working piston with a load engaging piston rod. The system further comprises a control circuit with a directional valve for directing pressure air to alternative sides of the working piston of each actuator for accomplishing movement of the working piston in alternative directions, and flow restrictions for restricting the air feed flow to the actual driving side of the working piston.

Actuator systems of this kind are used in the aluminium producing industry, in particular for crust breaking operations in electrolytic alumina reduction pots. Aluminium producing plants are usually big operations having a great number of electrolytic baths for reduction of aluminium oxide into metallic aluminium. For repeatedly breaking the crust layers inevitably formed on top of the electrolytic baths and thereby enabling supply of alumina, i.e. pulverized aluminium oxide into the baths, there are used a great number of big-size pneumatic actuators.

A problem inherent in this type of operations is that the crust layers to be broken may vary in thickness from zero to a very massive crust body, and to be able to deal with the thicker crust layers the actuators have to be big and powerful. For a big aluminium producing plant this creates a demand for a huge pressure air supply capacity, because driving the working piston of each actuator in reciprocating cycles requires a large amount of pressure air. This causes substantial costs, and there is a serious need in this type of industry to reduce the overall pressure air consumption and to bring down these costs Previously, a solution to this problem has been suggested which means that the current driving side of the actuator working piston is fed with pressure air via a flow restriction, whereas the opposite idling side of the working piston is vented through a substantially unrestricted outlet. This means that the pressure on the driving side of the working piston is quite low as long as the resistance to the piston movement is low, but increases automatically all the way up to the maximum pressure available in case the resistance to piston movement becomes higher.

In the above described field of use for pneumatic actuators, the crust layers are very thin and result in very low piston loads in more than 90% of all crust breaking cycles. In less than 1% of all cycles, the crusts are thick enough to require a full power action. This means that in a vast majority of the crust breaking cycles, the required air pressure behind the working piston is very low, as is the pressure air volume fed into the actuator cylinder. The above described restricted air feed to the actuator means a certain reduction in the consumed pressure air volume compared to previously used full pressure actuator operations, and of course it means a substantial cost saving for the industry. A condition for this, however, is that the piston is allowed to return to its start position immediately after reaching its extended extreme position, otherwise, there will still be a full pressure build-up in the actuator cylinder and a resulting pressure air waste.

Due to reasons as customer requirements and slow signal communication between position sensing means at the electrolytic pot and a control unit, the piston in previous actuators has been maintained for some time in its extended end position, which means that even if you use feed flow restrictions to keep down the drive pressure on the piston during piston movement, there will still be a full pressure build-up in the actuator cylinder after the piston has completed its strokes. Such pressure build-ups are of no use but a waste of expensive pressure air.

The main object of the present invention is to accomplish a pneumatic actuator system by which the pressure air consumption is brought down to a minimum such that no more pressure air than absolutely necessary is spent on the actuator operation while automatically providing maximum pressure and top power capacity when ever required.

Another object of the invention is to provide a pneumatic actuator system having short and quick air communication routes, so as to make the actuator operation distinct and without any delays in relation to given command signals.

A further object of the invention is to enable operation of more than one actuator by a single directional valve.

A still further object of the invention is to provide an actuator system wherein components sensitive to harsh environmental factors like heat, strong magnetic fields, chemically active substances etc. may be located remotely from the actuator without increasing the pressure air consumption.

Other objects and advantages of the invention will appear from the following specification containing a detailed description of preferred embodiments of the invention with reference to the accompanying drawings.

Figure 1:
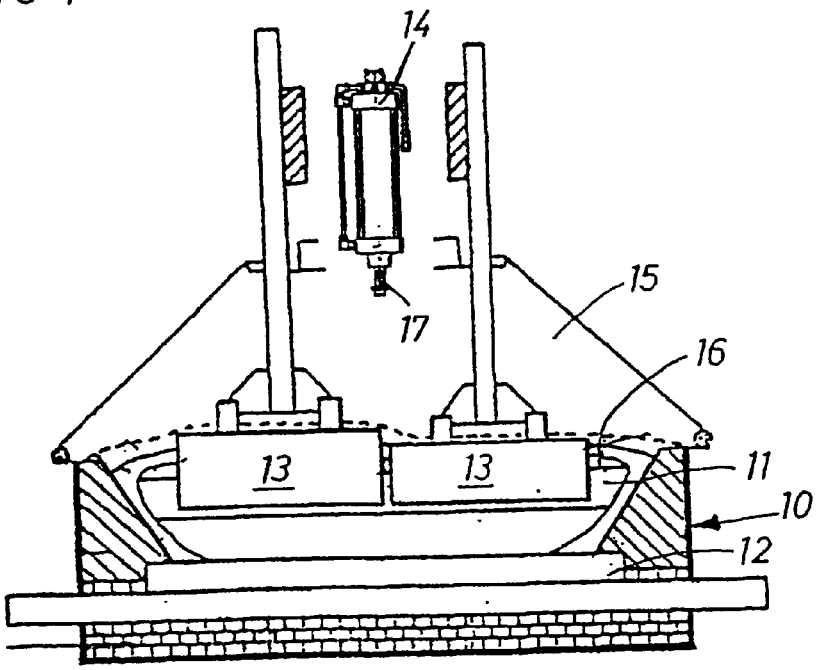
FIG. 1 illustrates schematically a section through an electrolytic bath in an aluminium producing plant, including a pneumatic actuator for crust breaking purposes.

As mentioned above, the pneumatic actuator system according to the invention is suitable for crust breaking operations in the aluminium producing industry. One type of aluminium producing plant comprises a number of electrolytic pots, and in FIG. 1 there is shown one such electrolytic pot 10 containing an electrolytic bath 11 and having a bottom cathode 12 and two anodes 13. The anodes 13 are movably supported on an overhead structure 15 (not shown in detail), and a single pneumatic actuator 14 mounted on the same structure 15. On top of the electrolyte 11, there is inevitably formed a crust layer 16 comprising residual material from the alumina reduction process.

As an electrolytic reduction process is going on, a crust layer is continuously formed on top of the bath, and to be able to add more alumina to the bath during the process the crust layer has to be repeatedly broken. To this end, the pneumatic actuator 14 is mounted vertically and provided with a crust breaking working implement 17, and when it is decided to accomplish a hole in the crust layer 16, the actuator 14 is activated to force the working implement 17 right through the crust layer. For adding alumina to the bath there is provided a so called point feeding device by which alumina is supplied right through the hole made by the working implement 17. The alumina feeding device is not a part of the invention and is therefore not described in further detail.

Figure 2:
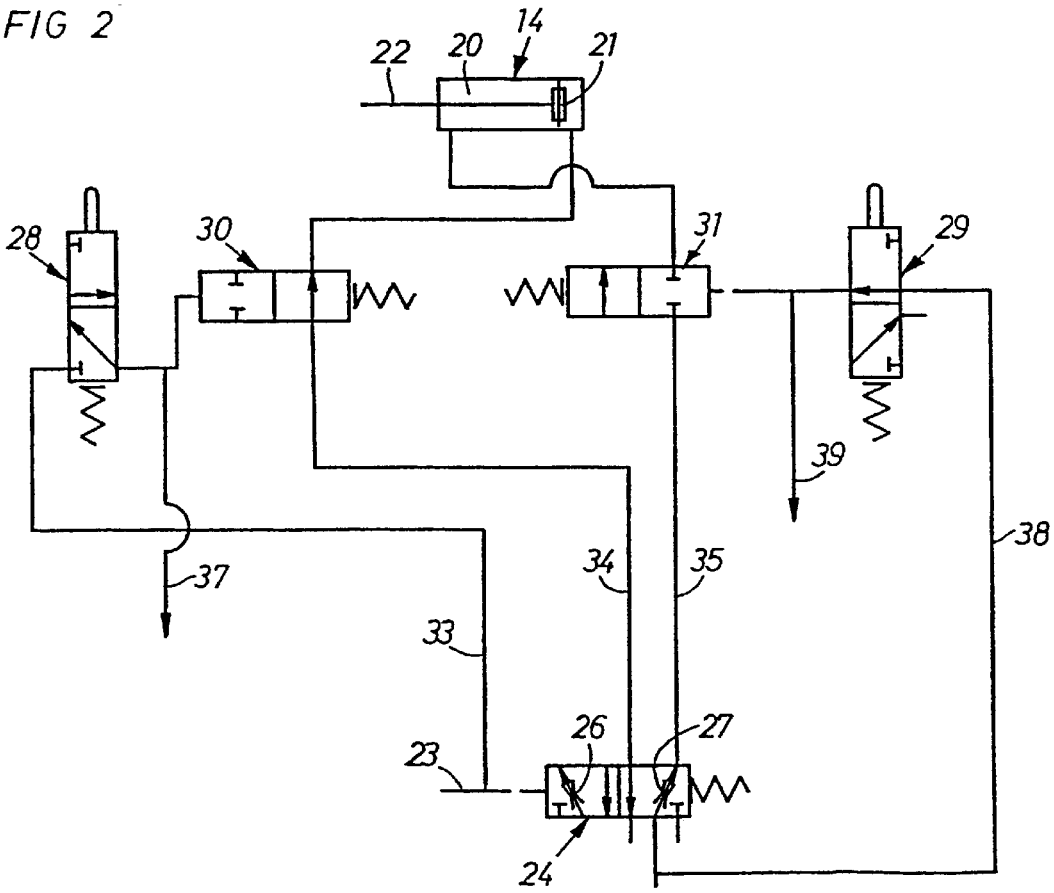
FIG. 2 shows schematically an actuator system according to one embodiment of the invention.

In FIG. 2 there is described an actuator system according one embodiment of the invention which comprises a piston-cylinder type actuator 14 having a cylinder 20, a piston 21 and a piston rod 22. The latter is intended to engage an external load of varying magnitude, for instance via a crust breaking implement 17 as described above. The system further comprises an actuator control circuit which includes a directional valve 24 connected to a pressure air source 25 and which has air communication ports for directing pressure air to and from the actuator 14. The directional valve 24 is spring biassed in one direction and pressure air activated by a start command signal in the opposite direction. The start command signal is supplied via a conduit 23. Alternatively, the start command signal may be provided as an electrical signal from a remote control unit for actuating an electromagnetic air valve located close to the directional valve 24.

The directional valve 24 shown in FIG. 2 also comprises flow restrictions 26,27 located in the alternative air feed passages through which pressure air is supplied to the actuator 14. Alternatively, these flow restrictions may be replaced by a single restriction located at the inlet port of the directional valve 24. However, the purpose and functional features of the flow restrictions 26,27 will appear from the following specification.

The control circuit further comprises two end position sensing valves 28,29 which are built-in in the actuator cylinder 20 for detecting and indicating whether the piston 21 has reached its extreme end positions.

Two air shut-off valves 30,31 are provided to alternatively let through or block air flow to and from the actuator 14, respectively, dependent on the current position of the piston 21 as detected by the end position sensing valves 28,29. Whereas the position sensing valves 28,29 are mechanically activated by the piston 21, the air shut-off valves 30,31 are pressure air activated. The position sensing valves 28,29 are spring biassed towards their closed positions, whereas the air shut-off valves 30,31 are spring biassed towards their open positions.

In operation of the actuator system, the directional valve 24 is given a start command signal via the conduit 23, whereby the valve 24 is shifted against the spring bias force to establish communication via the flow restriction 26 between the pressure air source 25 and an air communication passage 34. Since the air shut-off valve 30 is in its inactivated open position, there is free communication to the rear end of the cylinder 20, i.e. the driving side of the actuator piston 21. At the same time, however, the idling side of the piston 21, i.e. the piston rod side, is prevented from being vented through conduit 35 in that the shut-off valve 31 is closed. This is because the position sensing valve 29 is activated by the piston 21 and supplies pressure air to the maneuver side of the shut-off valve 31. However, due to a larger pressurised area at the rear end of the piston than at the piston rod end, and due the vertical orientation of the actuator 14 and the total weight of the piston 21, piston rod 22 and the working implement 17, a certain downward movement of the piston 21 will take place, long enough to deactivate the valve 29 and stop pressurising the valve 31 to closed position.

Now, the air shut-off valve 31 is shifted to its inactivated spring maintained open position to duct away vented air from the actuator 14 through the communication passage 35 and the directional valve 24. Thereafter, the piston 21 is able to start moving downwards, to the left in FIG. 2, so as to perform a crust breaking working stroke.

Due to the flow restriction 26 in the directional valve 24, the air feed to the actuator 14 takes place slowly, and since there is no flow restriction in the vent passage of the valve 24, the air on the idling side of the piston 21 will be vented to the atmosphere substantially without any back pressure. The restricted air feed to the actuator 14 prevents pressure from being built-up on the driving side of the piston 21 to a higher level than what is actually needed for the piston 21 to perform a working stroke and to reach its fully extended position. In case of a massive crust layer, a high pressure is required to move the piston, and as long as the end position sensing valve 28 is not activated, pressure air is continuously fed into the actuator cylinder 20 successively increasing the pressure until the piston 21 eventually reaches its fully extended position and the end sensing valve 28 is activated. When activated, the end sensing valve 28 opens up communication through the conduit 33 between the start signal conduit 23 and the maneuver side of the shut-off valve 30 making the latter shift to closed position. Thereby, the pressure air feed to the actuator 14 is stopped at once. An o.k. signal may be obtained via a conduit 37 connected downstream of the end sensing valve 28. Such a signal may be used for remote control of the process.

The above described condition will prevail until the start command signal in conduit 23 is discontinued. The actuator piston 21 remains in its fully extended position, and no further pressure air is supplied to the driving side of the piston 21.

When the start command signal in conduit 23 is discontinued, the directional valve 24 returns by spring force to its original position, to the left in FIG. 2, wherein instead the pressure air source 25 is connected to the piston rod side of the actuator piston 21 via passage 35. This communication is open since the end position sensing valve 29 occupies its inactive closed position, and the air shut-off valve 31 occupies its spring maintained open position. Venting of the rear idling side of the piston 21 is established in that the pressure of the start command signal supplied via conduit 33 and the activated valve 28 stops acting on the maneuver side of the shut-off valve 30 making the latter return to its inactive open position.

Now, the piston 21 starts moving upwards, to the right in FIG. 2, and because of the air feed restriction 27 in the directional valve 24, no more pressure air is supplied to the actuator than what is needed to lift the piston 21, piston rod 22 and working implement 17 back to their upper rest positions. The upper or right hand side of the piston 21 is vented through passage 34. As soon as the piston 21 reaches its fully retracted position, the end sensing valve 29 is shifted to its open position, against a spring bias force. Thereby, communication is established between the maneuver side of the shut-off valve 31 and the pressure air source 25 via a passage 38, resulting in a shifting of the shut-off valve 31 to its closed position, as illustrated in FIG. 2. As in the opposite end position, an o.k. signal may be obtained via conduit 39 connected downstream of the end position sensing valve 29.

From the above description of the actuator system it is apparent that by the employment of the air shut-off valves 30,31 and the end position sensing valves 28,29 there is obtained an instantaneous pressure air shut-off as the piston 21 reaches either one of its extreme end positions. Whereas the directional valve 24 normally has to be located at a distance from the actuator 14 and the harsh environment in the close vicinity of the electrolytic bath, the shut-off valves 28,29 which are of a simple and rugged design may be located close to the actuator 14 so as to accomplish a very quick and distinct air shut-off without any unnecessary delays. The combination of end position sensing valves and separate air shut-off valves provides a substantially improved pressure air economy, because the needed air pressure and the consumed air volume are continuously and automatically kept at a minimum level.

Figure 3:
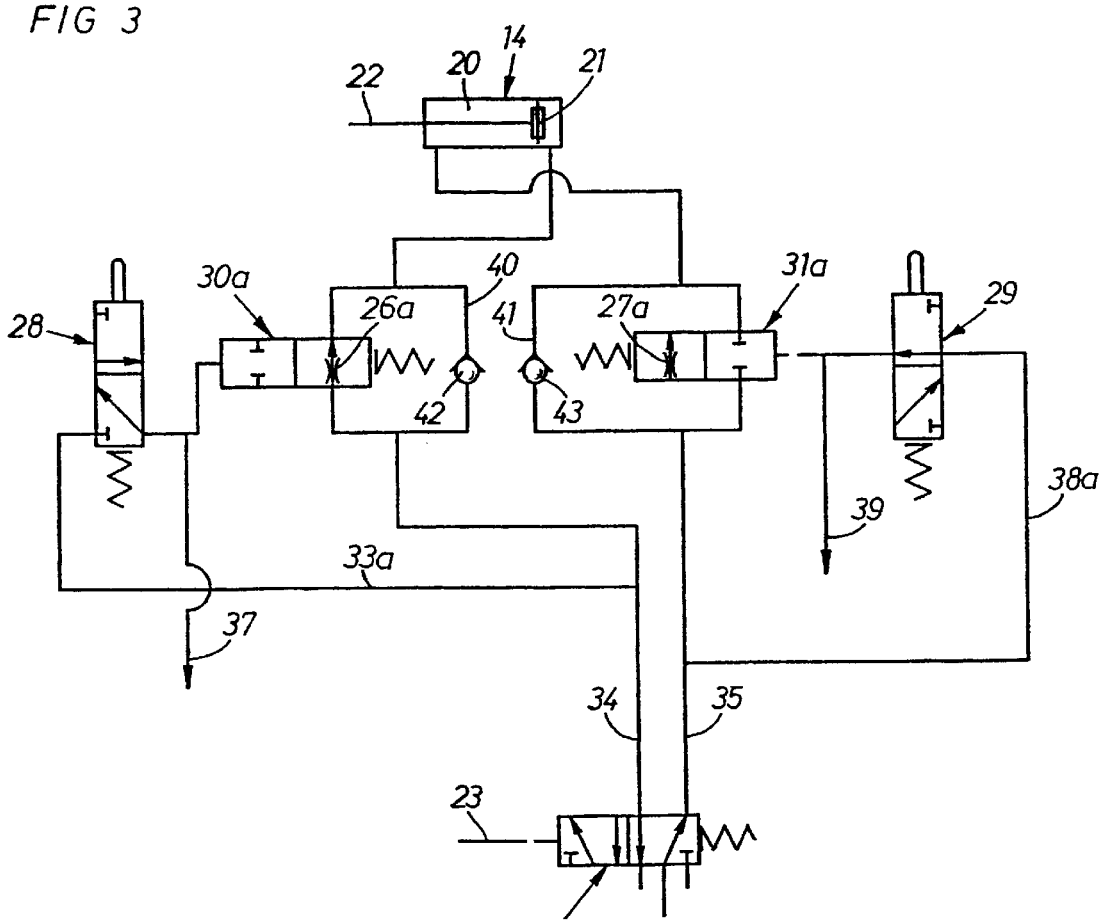
FIG. 3 shows an actuator system according to an alternative embodiment of the invention.

In FIG. 3, there is illustrated an alternative embodiment of the invention, wherein air feed flow restrictions 26*a*,27*a* are integrated in the air shut-off valves 30*a*,31*a*. This means a further improvement of the actuator control function, because in this case the pressure drops caused by the long conduits between the directional valve 24 and the actuator 14 are minimized since a less sensitive full pressure air feed is maintained all the way up to the shut-off valves 30*a*,31*a*. In order to avoid flow restrictions on the vented side of the actuator piston 21, the shut-off valves 30,31 have been provided with shunts 40,41 including check valves 42,43.

By the location of the air feed restrictions 26*a*,27*a* to the shut-off valves 30*a*,31*a*, it is made possible to obtain pressure air supply to the position sensing valves 28,29 via conduits 33*a*,38*a* connected to the conduits 34,35 where full pressure is available when required. So, air supply conduits 33*a* and 38*a* may be connected to the conduits 34,35 at a location close to the actuator 14 instead of a location close to the directional valve 24. This reduces the number of conduits between the directional valve 24 and the actuator 14. It also means that the directional valve 24 can be located at a distance from the actuator 14 away from the aggressive atmosphere around the electrolytic bath. A further advantage gained by this alternative location of the air feed restrictions 26*a*,27*a* is a less complicated directional valve 24, i.e. the directional valve 24 may be of a simple conventional design.

Figure 4:
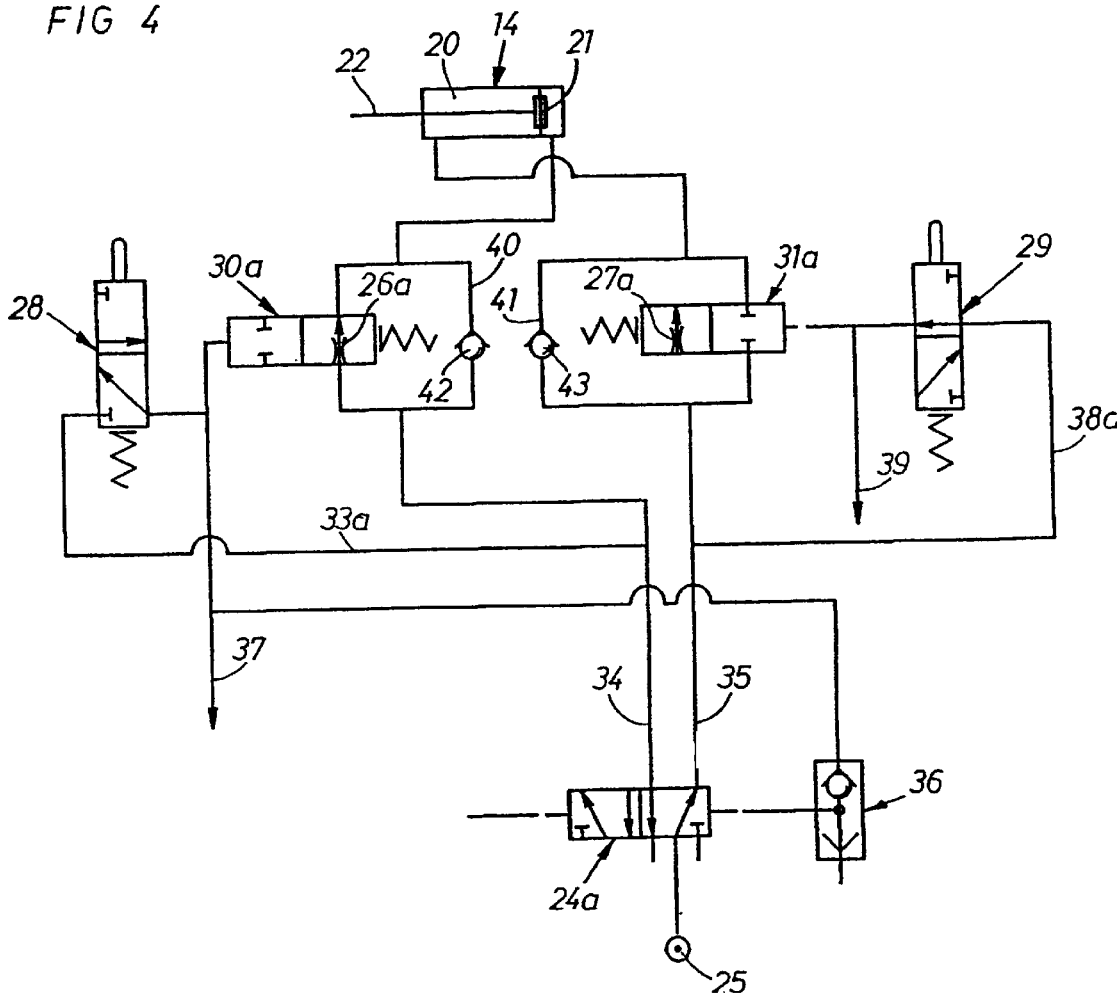
FIG. 4 shows an actuator system according to a second alternative embodiment of the invention.

A slight variation of the above described device is illustrated in FIG. 4. Instead of having a spring biassed directional valve 24 which automatically returns to its operation start position as soon as the start command signal is discontinued, there is employed a bi-stable directional valve 24*a*. An OR-gate 36 is connected between the o.k. signal conduit 37 and one maneuver side of the directional valve 24*a*. By this OR-gate 36 it is possible to reset the directional valve 24*a* either automatically by the o.k. signal obtained from the end position sensing valve 28 or by a reset signal provided by a remote control unit (not shown).

It is to be noted that the embodiments of the invention are not limited to the described examples but may be freely varied within the scope of the claims.

For instance, the actuator system according to the invention may be used at alumina reduction pots where the crust layer breaking device comprises a horizontal crust breaking beam. In that application, one actuator is connected at each end of the breaking beam for vertical, substantially parallel movement of the beam through the crust layer. The two actuators are fed with pressure air by a common directional valve, and the flow restrictions in the feed passages of the directional valve will be effective in distributing the air flow to both actuators in response to their individual instant load, such that the actuator having the lowest load gets the most pressure air. This means that the drive pressures in the actuators are automatically adapted to the actual individual load level, such that when one of the actuators has reached its extreme positions and the other has not the latter will be continuously pressurised until it has reached its extreme end position as well. Meanwhile, the air supply to the first actuator to reach its extreme end position is cut off by the respective air shut-off valve.

What is claimed is:

1. Pneumatic actuator system, comprising: one or more piston-cylinder type actuators (14) each having a working piston (21) with a load engaging piston rod (22), a control circuit including a directional valve (24;24*a*) connected to a pressure air source (25) and arranged to direct pressure air to alternative driving sides of the working piston (21) of each actuator (14) for accomplishing movement of the working piston (21) in alternative directions, characterized in that each actuator (14) is provided with end position sensors (28,29) for detecting and indicating the extreme end positions of the working piston (21), air feed shut-off valves (30,31; 30*a*,31*a*) connected to said end position sensors (28,29) and arranged to cut off the air feed to the current driving side of the working piston (21) as an extreme end position is reached and indicated by the respective end position sensor (28,29), and air flow restrictions (26,27;26*a*,27*a*) arranged to limit automatically the air feed flow to the current driving side of the working piston (21), thereby limiting automatically the pressure air volume supplied to the driving side of the working piston (21) at low piston rod load magnitudes.

2. Actuator system according to claim 1, wherein said directional valve (24;24*a*) is located remotely from the actuator or actuators (14), whereas said air feed shut-off valves (30,31; 30*a*,31*a*) form a unit together with the respective actuator (14).

3. Actuator according to claim 2, wherein said air flow restrictions (26*a*,27*a*) are located in said air feed shutoff valves (30*a*, 31*a*).

4. Actuator according to claim 2, wherein said shut-off valves (30,31; 30*a*,31*a*) are mounted on the outside of the respective actuator (14), whereas said end position sensors (28,29) are built-in in the respective actuator (14).

5. Pneumatic actuator system for crust breaking in electrolytic aluminum reduction baths (10), comprising one or more piston-cylinder actuators (14) each having a working piston (21) with a piston rod (22) connected to a crust breaking implement (17), a control circuit including a directional valve (24;24*a*), air flow restrictions (26,27) inserted between the actuator (14) and the directional valve (24;24) for restricting the air feed flow to the current driving side of the working piston (21), characterized in that each actuator (14) is provided with end position sensors (23,29) for detecting and indicating the extreme end positions of the working piston (21), air feed shut-off valves (30,31; 30*a*,31*a*) connected to said end position sensors (28,29) and arranged to cut off the pressure feed to the current driving side of the working piston (21) as an extreme end position of the working piston (21) is reached and indicated by the respective end position sensor (23,29), and air flow restrictions (26,27) disposed between the actuator (14) and the directional valve (24;24) for restricting automatically the air feed flow to the current driving side of the working piston (21) at low piston rod load magnitudes, wherein said end position sensors (28,29) and said air feed shutoff valves (30,31; 30*a*,31*a*) are disposed integrally with the actuator (14) to form a working unit to be located at the electrolytic reduction bath (10), whereas said directional valve (24,24*a*) is located remotely from the electrolytic bath (10).

6. Actuator system according to claim 5, wherein said flow restrictions (26*a*,27*a*) are integrated with the air feed shut-off valves (30*a*,31*a*).

7. Actuator system according to claim 6, wherein two actuators (14) have their working pistons connected to a common crust breaking beam, said actuators (14) sharing a common remotely located directional valve (24;24*a*) but comprising separate end position sensors (28,29) and air feed shut-off valves (30,31; 30*a*, 31*a*).

8. Actuator system according to claim 6, wherein each actuator (14) operates a single-point crust breaking implement (17) which extends in a substantial co-axial disposition relative to said piston rod (22).

9. Actuator system according to claim 5, wherein two actuators (14) have their working pistons connected to a common crust breaking beam, said actuators (14) sharing a common remotely located directional valve (24;24*a*) but comprising separate end position sensors (28,29) and air feed shut-off valves (30,31; 30*a*, 31*a*).

10. Actuator system according to claim 5, wherein each actuator (14) operates a single-point crust breaking implement (17) which extends in a substantial co-axial disposition relative to said piston rod (22).

* * * * *